US008371826B1

(12) United States Patent
Johnson et al.

(10) Patent No.: US 8,371,826 B1
(45) Date of Patent: Feb. 12, 2013

(54) GEYSER PUMP

(76) Inventors: George E. Johnson, Downsville, LA (US); Richard G. Dupree, Monroe, LA (US)

( * ) Notice: Subject to any disclaimer, the term of this patent is extended or adjusted under 35 U.S.C. 154(b) by 632 days.

(21) Appl. No.: 12/583,897

(22) Filed: Aug. 27, 2009

Related U.S. Application Data

(60) Provisional application No. 61/190,745, filed on Sep. 2, 2008.

(51) Int. Cl.
*F04F 1/06* (2006.01)

(52) U.S. Cl. ..... 417/118; 417/122

(58) Field of Classification Search ..... 417/118, 417/122

See application file for complete search history.

(56) References Cited

U.S. PATENT DOCUMENTS

| | | | | |
|---|---|---|---|---|
| 3,898,018 | A | 8/1975 | Weis | 417/118 |
| 3,995,664 | A * | 12/1976 | Nelson | 138/43 |
| 4,442,858 | A | 4/1984 | Everett | 137/207 |
| 4,478,211 | A | 10/1984 | Haines et al. | 126/433 |
| 4,676,225 | A | 6/1987 | Bartera | 126/433 |
| 4,802,829 | A | 2/1989 | Miller | 417/12 |
| 5,611,671 | A | 3/1997 | Tripp, Jr. | 417/126 |
| 6,162,020 | A | 12/2000 | Kondo | 417/54 |
| 6,234,761 | B1 * | 5/2001 | Kocsis et al. | 417/118 |
| 7,294,255 | B2 | 11/2007 | Kondo | 210/151 |
| 2007/0166171 | A1 * | 7/2007 | Kondo | 417/118 |

* cited by examiner

*Primary Examiner* — Charles Freay
*Assistant Examiner* — Patrick Hamo
(74) *Attorney, Agent, or Firm* — R. Keith Harrison

(57) ABSTRACT

A geyser pump includes an air chamber having an air chamber interior, a generally U-shaped bubble-forming loop external to and disposed in fluid communication with the air chamber and a liquid delivery conduit disposed in fluid communication with the bubble-forming loop. A liquid recirculation/transfer system having an orifice disk assembly and a geyser pump is also disclosed.

15 Claims, 6 Drawing Sheets

GEYSER PUMP

CROSS-REFERENCE TO RELATED APPLICATIONS

This application claims the benefit of and incorporates by reference in its entirety U.S. provisional application No. 61/190,745, filed Sep. 2, 2008 and entitled "Geyser Pump".

TECHNICAL FIELD

The present disclosure relates to geyser pumps. More particularly, the present disclosure relates to a geyser pump having an external bubble-forming loop which forms liquid-transporting bubbles that are capable of transporting large volumes of water at a high velocity.

BACKGROUND

Air lift liquid pumps are pumps which move a liquid from a tank or vessel by injecting air into the lower end of a pipe submerged in the liquid inside the tank or vessel. The buoyancy of the injected air forms air bubbles which rise rapidly in the pipe and push a portion of the liquid above the bubbles out of the pipe. Air lift liquid pumps are capable of a wide range of liquid flow rates and lift capabilities. A geyser pump is a particular type of air lift liquid pump in which air over time is concentrated into successive bubbles, each of which may completely fill a section of a submerged pipe. Each bubble forces a large portion of the liquid above it out of the pipe such that the liquid is removed from the tank or vessel in volumetric increments.

A geyser pump is needed which is amenable to a variety of applications and is capable of moving large volumes of water at high velocity.

SUMMARY

The present disclosure is generally directed to a geyser pump. An illustrative embodiment of the geyser pump includes an air chamber having an air chamber interior, a generally U-shaped bubble-forming loop external to and disposed in fluid communication with the air chamber and a liquid delivery conduit disposed in fluid communication with the bubble-forming loop.

The present disclosure is further generally directed to a liquid recirculation/transfer system. An illustrative embodiment of the liquid recirculation/transfer system includes an aerator; an orifice disk assembly comprising a selected one of a plurality of orifice disks having central air flow openings of various diameters, respectively, provided in pneumatic communication with the aerator; and a geyser pump comprising an air chamber having an air chamber interior disposed in pneumatic communication with the central air flow opening of the orifice disk in the orifice disk assembly, a generally U-shaped bubble-forming loop disposed in fluid communication with the air chamber and a liquid delivery conduit disposed in fluid communication with the bubble-forming loop. The orifice disks are selectively interchangeable in the orifice disk assembly according to the central air flow openings of various diameters, respectively, to facilitate flow of a selected quantity of air through the geyser pump and a selected quantity of liquid from the geyser pump through the liquid delivery conduit.

BRIEF DESCRIPTION OF THE DRAWINGS

The disclosure will now be made, by way of example, with reference to the accompanying drawings, in which.

DETAILED DESCRIPTION

Figure 3:
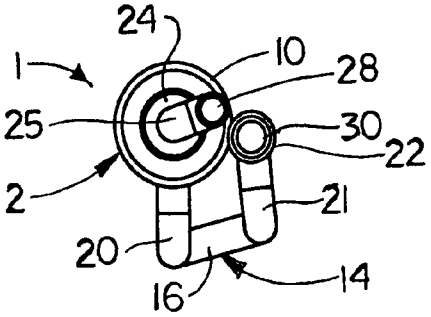
FIG. 3 is a top view of an illustrative embodiment of the geyser pump.
Figure 4:
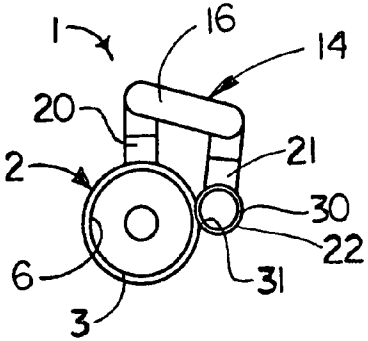
FIG. 4 is a bottom view of an illustrative embodiment of the geyser pump.
Figure 2:
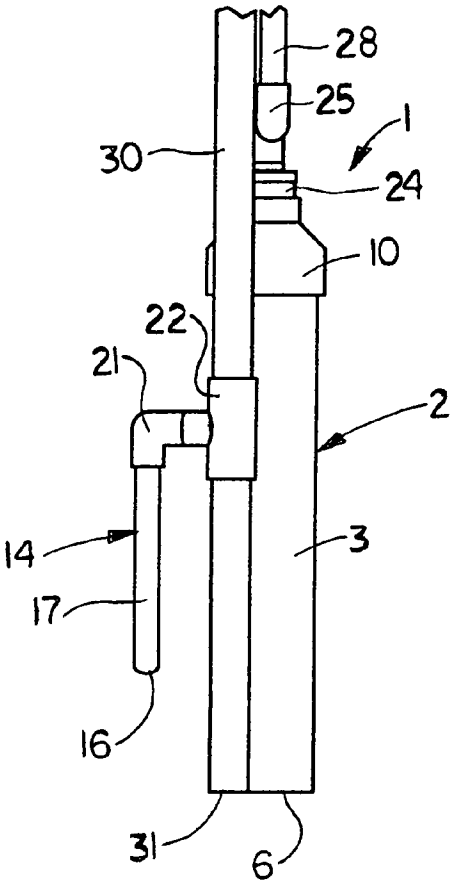
FIG. 2 is a side view of an illustrative embodiment of the geyser pump.
Figure 1:
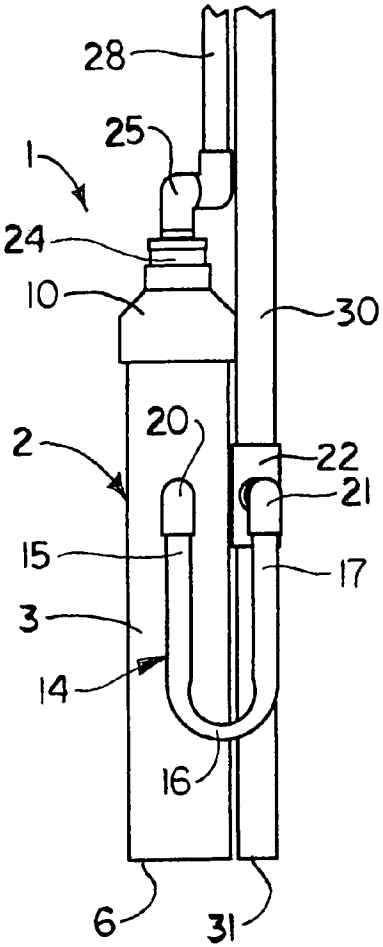
FIG. 1 is a front view of an illustrative embodiment of the geyser pump.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the claims. Furthermore, there is no intention to be bound by any expressed or implied theory presented in the preceding technical field, background, brief summary or the following detailed description.

Referring initially to FIGS. 1-5 of the drawings, an illustrative embodiment of the geyser pump is generally indicated by reference numeral 1. The components of the geyser pump 1 may be plastic or any other suitable rigid material. In some embodiments, at least some of the components of the geyser pump 1 may be polyvinylchloride (PVC). The geyser pump 1 includes an air chamber 2. The air chamber 2 has an air chamber wall 3 which may have a generally elongated, cylindrical shape.

Figure 5:
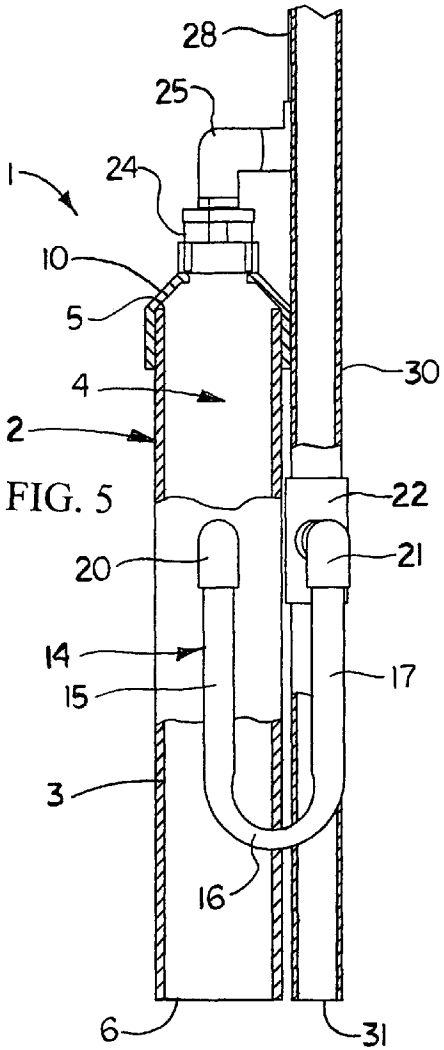
FIG. 5 is a front view, partially in section, of an illustrative embodiment of the geyser pump.

As illustrated in FIG. 5, the air chamber wall 3 defines an air chamber interior 4. The air chamber wall 3 has an upper end 5 and a lower end 6, which may be open. In some embodiments, an air chamber cap 10 may be provided on the upper end 5 of the air chamber wall 3. The air chamber cap 10 may be threadably or otherwise attached to the air chamber wall 3 according to the knowledge of those skilled in the art. Alternatively, the air chamber cap 10 may be formed integrally with the air chamber wall 3.

An air supply conduit 28 is disposed in pneumatic communication with the air chamber interior 4 (FIG. 5) of the air chamber 2 such as through the air chamber cap 10. The air supply conduit 28 may be connected to the air chamber interior 4 of the air chamber 2 according to any suitable technique which is known by those skilled in the art. In some embodiments, a conduit connector 24 is disposed in pneumatic communication with the air chamber cap 10. An elbow connector 25 extends from the conduit connector 24. The air supply conduit 28 is disposed in pneumatic communication with the elbow connector 25.

A bubble-forming loop 14 is disposed in fluid communication with the air chamber interior 4 of the air chamber 2, between the upper end 5 and the lower end 6 of the air chamber wall 3. The bubble-forming loop 14 may have a generally U-shaped configuration, with a generally elongated, straight descending segment 15 which is disposed in fluid communication with the air chamber interior 4 such as through an inlet elbow connector 20, for example; a curved segment 16 which extends from the descending segment 15; and a generally elongated, straight ascending segment 17 which extends from the curved segment 16. The longitudinal axis of the descending segment 15 and the longitudinal axis of the ascending segment 17 may be disposed in generally parallel relationship with respect to each other. The descending segment 15 and the ascending segment 17 may each be disposed in generally parallel relationship with respect to a longitudinal axis of the air chamber 2. The bubble-forming loop 14 may be disposed in a plane which is generally parallel to a longitudinal axis of the liquid delivery conduit 30.

A generally elongated liquid delivery conduit 30 is disposed in fluid communication with the ascending segment 17 of the bubble-forming loop 14, such as through an outlet elbow connector 21, for example. A conduit coupling 22 may connect the outlet elbow connector 21 to the liquid delivery conduit 30. The liquid delivery conduit 30 has a lower end 31 which may be open and may be disposed generally adjacent to the lower end 6 of the air chamber 2. The longitudinal axis of the liquid delivery conduit 30 may be disposed in generally parallel relationship with respect to the longitudinal axis of the air chamber 2 and with the longitudinal axes of the descending segment 15 and ascending segment 17, respectively, of the bubble-forming loop 14. The descending segment 15, the curved segment 16 and the ascending segment 17 of the bubble-forming loop 14 may be external to the air chamber 2 and the liquid delivery conduit 30.

Referring next to FIGS. 6-10 of the drawings, a complete pumping cycle of the geyser pump 1 is illustrated. In operation, the geyser pump 1 pumps a volume of liquid 34 through the liquid delivery conduit 30 to a desired destination (not illustrated) such as a receiving tank or vessel, for example. The liquid 34 may be water or any other liquid which is to be pumped through the liquid delivery conduit 30. Accordingly, the geyser pump 1 is submerged in the liquid 34 which may be contained in a tank or vessel (not illustrated). The liquid 34 enters the air chamber interior 4 of the air chamber 2 typically through the open lower end 6 of the air chamber 2. An air supply (not illustrated) is connected to the air supply conduit 28, whereas the liquid delivery conduit 30 is disposed in fluid communication with the tank or vessel (not illustrated) into which the liquid 34 is to be pumped. The air supply is capable of generating a constant supply of air having a pressure which is greater than that of the pressure of the liquid 34 which enters the air chamber 2 through the lower end 6.

Figures 6, 7, 8, 9, 10:
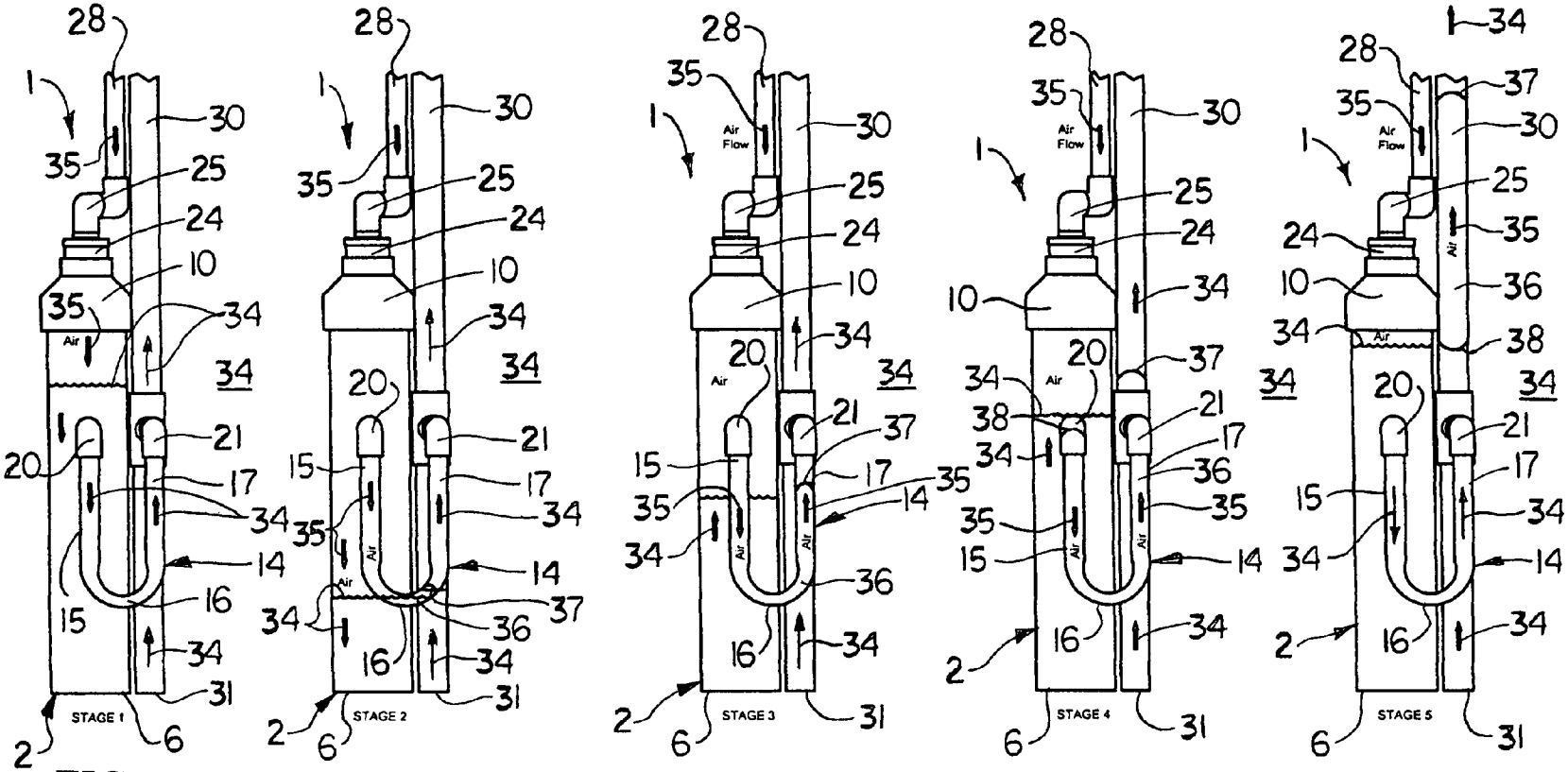
FIGS. 6-10 are respective front views of an illustrative embodiment of the geyser pump, more particularly illustrating sequential operation of the geyser pump in moving a liquid.

As illustrated in FIG. 6, liquid 34 enters the air chamber 2 through the typically open lower end 6 and generally fills most of the air chamber interior 4 (FIG. 5). The liquid 34 additionally flows from the air chamber interior 4 and through the descending segment 15, the curved segment 16 and the ascending segment 17, respectively, of the bubble-forming loop 14. From the bubble-forming loop 14, the liquid 34 enters the liquid delivery conduit 30. Liquid 34 also enters the liquid delivery conduit 30 through the open lower end 31 thereof. Air 35 flows under pressure from the air supply conduit 28 and into the air chamber interior 4 and becomes trapped in the air chamber interior 4. The pressure of the air 35 in the air chamber interior 4 increases as the air 35 forces the liquid 34 lower in the air chamber interior 4.

As illustrated in FIG. 7, the pressurized air 35 eventually forces the surface of the descending liquid 34 to the level of the curved segment 16 of the bubble-forming loop 14. As the air 35 descends below the inlet of the descending segment 15 of the bubble-forming loop 14, some of the air 35 enters the descending segment 15 and begins to push the liquid 34 from the bubble-forming loop 14 into the liquid delivery conduit 30. A leading edge 37 of a liquid-moving bubble 36 is formed at the interface of the air 35 and the liquid 34 in the bubble-forming loop 14.

As illustrated in FIG. 8, once the liquid-moving bubble 36 begins to form, buoyancy forces the liquid-moving bubble 36 through the bubble-forming loop 14, as illustrated, and ultimately, into the liquid delivery conduit 30. As the air 35 continues to flow from the air chamber interior 4 into the bubble-forming loop 14, the pressure of the air 35 in the air chamber interior 4 drops. Consequently, the level of the liquid 34 quickly rises in the air chamber interior 4. As the air 35 continues to flow into the bubble-forming loop 14 from the air chamber interior 4, the rising liquid 34 reaches a dynamic equilibrium which tends to maintain a fairly constant air pressure in the liquid-moving bubble 36.

As illustrated in FIG. 9, the liquid 34 continues to rise in the air chamber interior 4 until the level of the liquid 34 reaches and then surpasses the inlet of the bubble-forming loop 14. At that point, the liquid 34 enters the descending segment 15 of the bubble-forming loop 14. A trailing edge 38 of the liquid-moving bubble 36 is formed at the interface between the liquid 34 and the air 35 of the liquid-moving bubble 36. The liquid 34 temporarily stops further flow of the liquid-moving bubble 36 through the bubble-forming loop 14.

As illustrated in FIG. 10, the level of the liquid 34 continues to rise in the air chamber interior 4 until the liquid 34 reaches an equilibrium point with the pressure of the air 35. By that point, the liquid 34 entering the bubble-forming loop 14 has pushed the liquid-moving bubble 36 from the bubble-forming loop 14 and into the liquid delivery conduit 30. The liquid-moving bubble 36 is cleanly-formed and traps the liquid 34 above it in the liquid delivery conduit 30. Eventually, the rising liquid-moving bubble 36 forces the liquid 34 above it out of the liquid delivery conduit 30 in a sudden "geyser" action. This action also draws additional liquid into the liquid delivery conduit 30 through the open end 31 thereof, preparatory to the next cycle.

Figure 11:
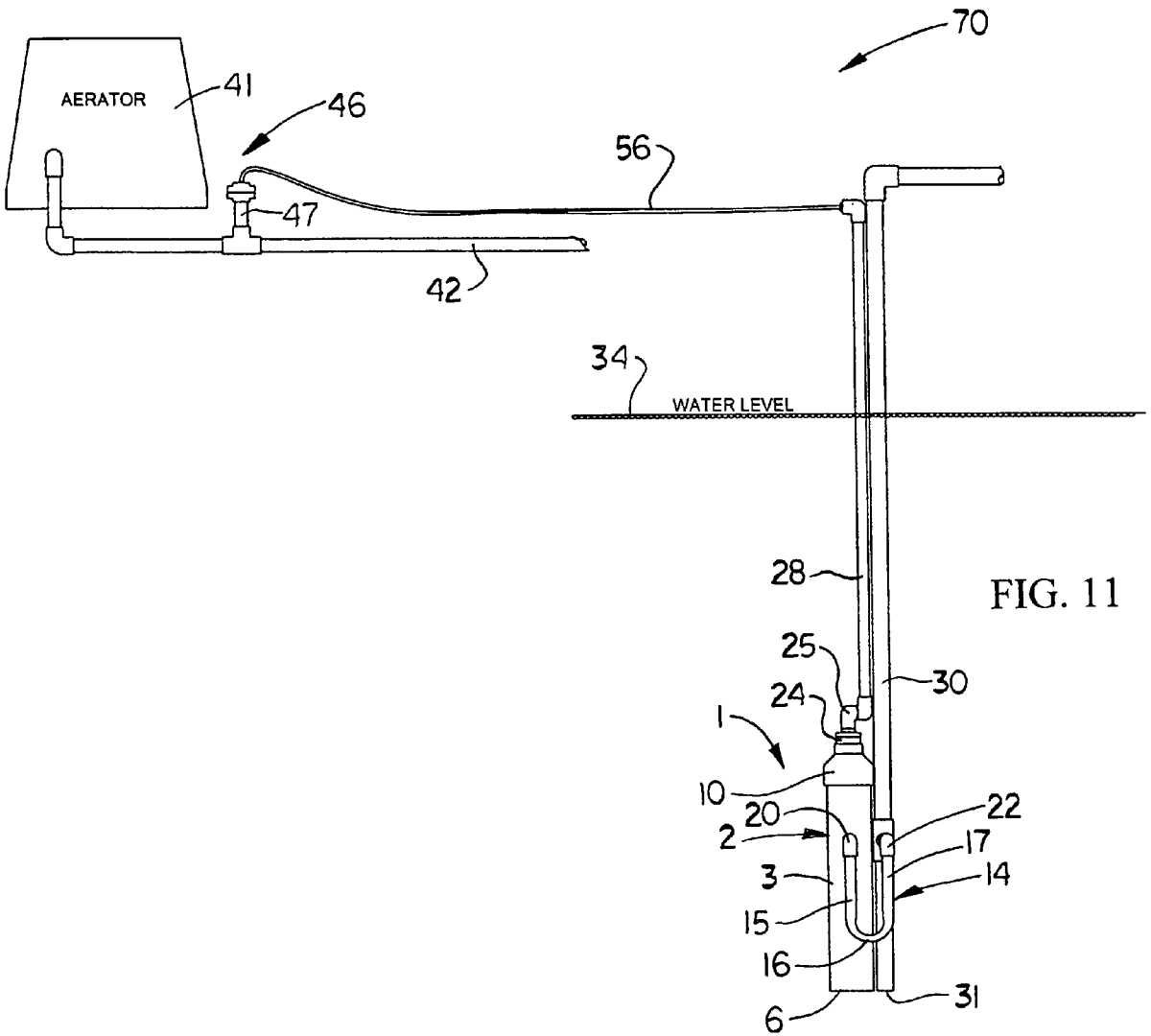
FIG. 11 is a schematic diagram of an illustrative embodiment of a liquid recirculation/transfer system in implementation of an illustrative embodiment of the geyser pump.
Figures 12, 14:
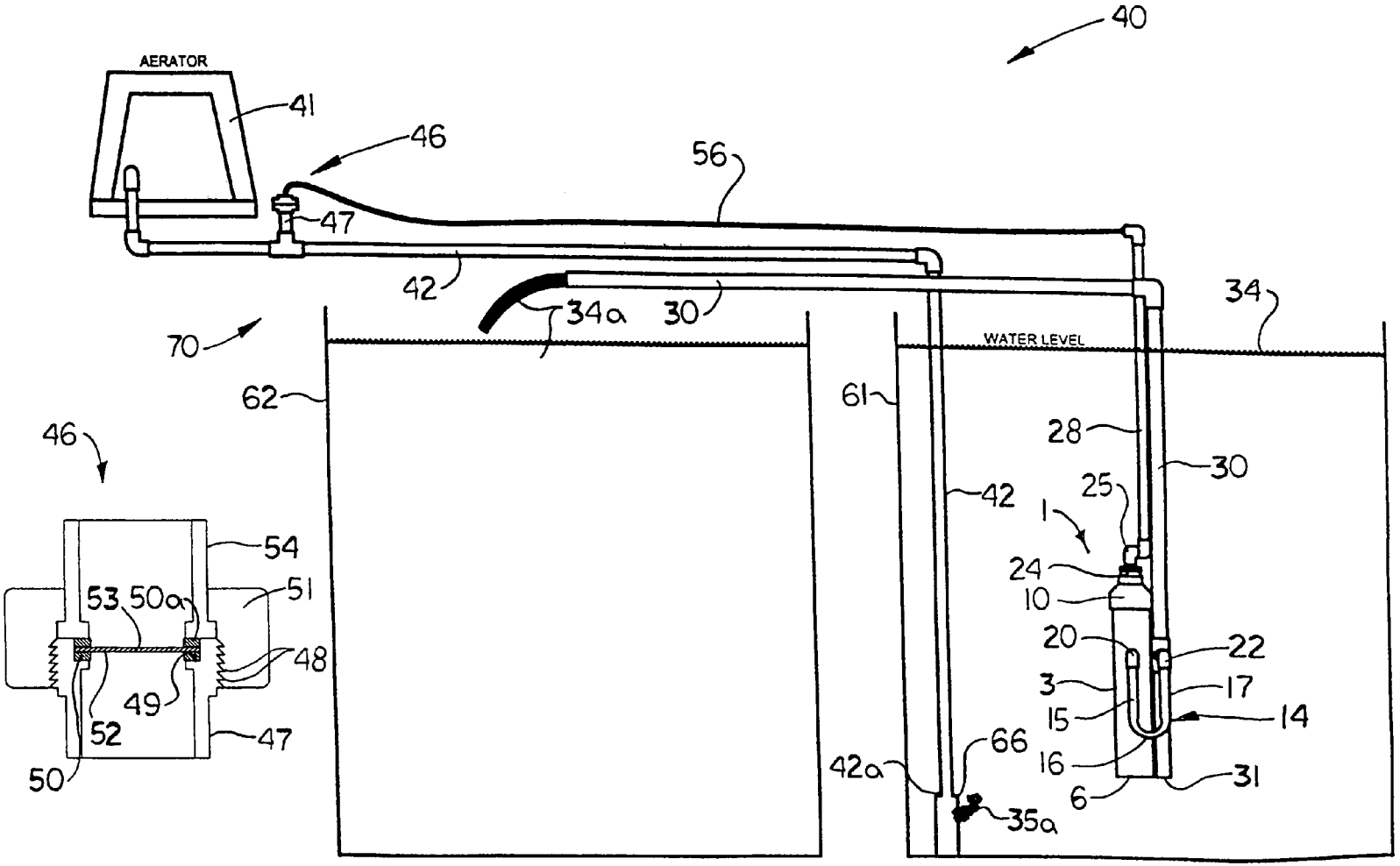
FIG. 12 is a sectional view of an orifice disk assembly which is adapted to distribute a selected quantity of bubble-forming air to the geyser pump in operation of the water treatment system.
FIG. 14 is a schematic diagram of an illustrative water treatment system which is suitable for implementation of the geyser pump.
Figure 13:
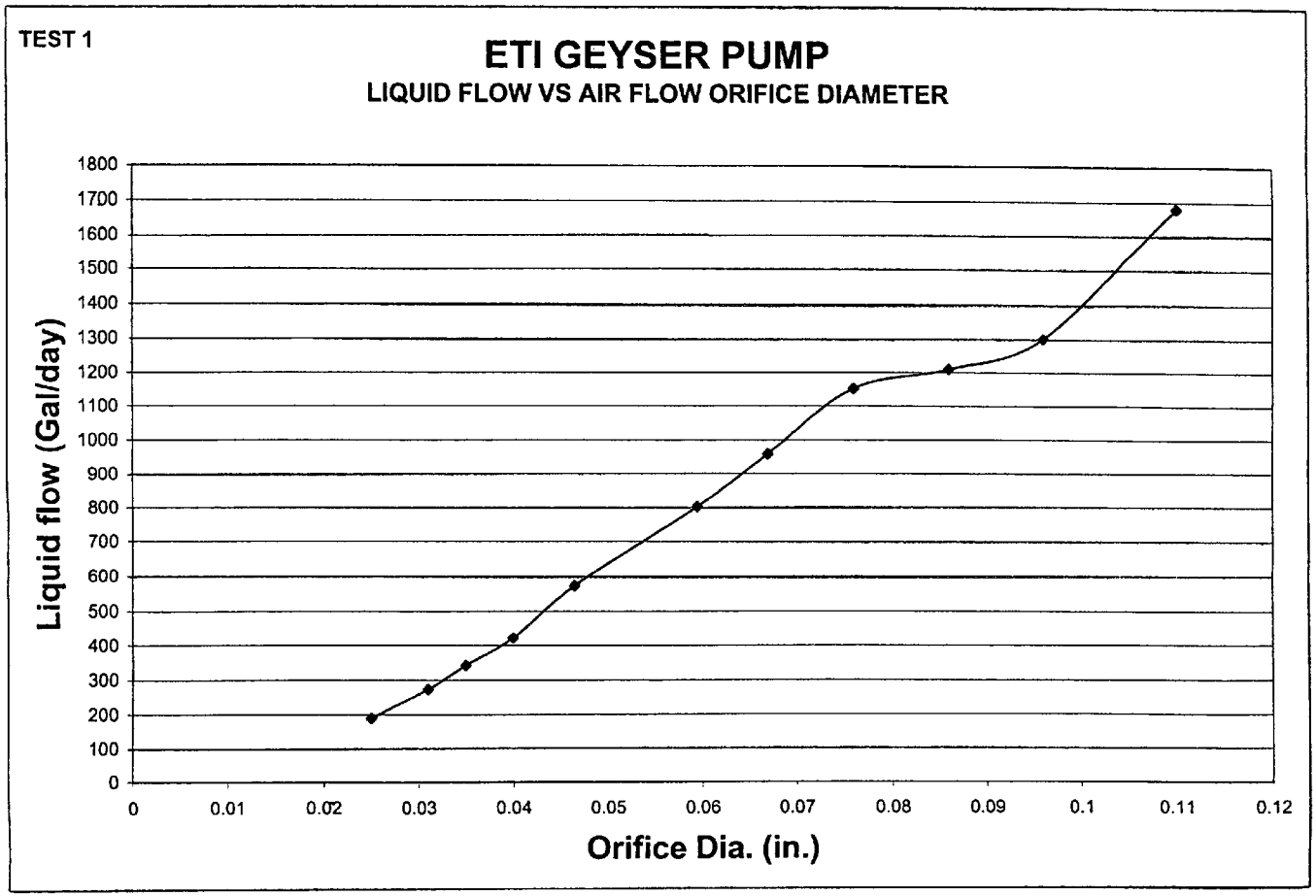
FIG. 13 is an exemplary line graph on which the rate of flow of liquid (in gallons per day) pumped by the geyser pump is plotted as a function of the diameter (in inches) of an air flow opening in an orifice disk in the orifice disk assembly.

Referring next to FIGS. 11-13 of the drawings, an illustrative liquid recirculation/transfer treatment system 70 which is suitable for implementation of the geyser pump 1 is illustrated in FIG. 11. The liquid recirculation/transfer system 70 is suitable for any application in which a liquid 34 is to be recirculated within or transferred into or out of a system. The liquid recirculation/transfer system 70 includes an aerator 41 which provides a constant flow of air. A main air line 42 is connected to an outlet of the aerator 41. An orifice disk assembly 46 is disposed in pneumatic communication with the main air line 42. A pump air delivery line 56 is disposed in pneumatic communication with the orifice disk assembly 46 and with the air supply conduit 28 which communicates with the air chamber 2 of the geyser pump 1, as was heretofore described with respect to FIGS. 1-5. The geyser pump 1 is submerged to a selected depth in liquid 34 which may be contained in a tank or vessel (not illustrated).

In operation of the liquid recirculation/transfer system 70, air is distributed from the aerator 41 and through the main air line 42. The orifice disk assembly 46 receives a portion of the air from the main air line 42 and precisely controls the quantity of air which is provided from the aerator 41 to the air chamber 2 of the geyser pump 1 through the pump air delivery line 56 and the air supply conduit 28, respectively. This quantity of air which the aerator 41 supplies to the geyser pump 1 through the orifice disk assembly 46 determines the size or volume of the liquid-moving bubbles 36 (FIGS. 7-10) that successively form in the bubble-forming loop 14 during the respective pumping cycles of the geyser pump 1. In turn, the size or volume of each liquid-moving bubble 36 determines the quantity of liquid 34 which each liquid-moving bubble 36 transports through the liquid delivery conduit 30 and to the desired destination (not illustrated) in each pumping cycle. Therefore, the orifice disk assembly 46 is operable to sustain stable and repeatable flow rates of the liquid 34 through the liquid delivery conduit 30 based on accurate control of the flow of air to the geyser pump 1.

As illustrated in FIG. 12, an illustrative embodiment of the orifice disk assembly 46 includes the air inlet conduit 47, which is disposed in pneumatic communication with the main air line 42 (FIG. 11). Exterior conduit threads 48 may be provided on the air inlet conduit 47. An annular gasket seat 49 may be provided in the air inlet conduit 47. A first resilient, rubber or plastic seal gasket 50 is seated in the gasket seat 49. An orifice disk 52, through which extends a central air flow opening 53, is seated on the first seal gasket 50 and spans the interior of the air inlet conduit 47. A second seal gasket 50*a* is seated on the outer portion of the orifice disk 52. An air outlet conduit 54, to which the pump air delivery line 56 (FIG. 11) is pneumatically connected, may be seated against the second seal gasket 50*a*. An interiorly-threaded retaining nut 51 engages the exterior conduit threads 48 on the air inlet conduit 47 and also engages the exterior surface of the air outlet conduit 54 to secure the air outlet conduit 54 to the air inlet conduit 47 in an airtight fit. Accordingly, in operation of the liquid recirculation/transfer system 70, the aerator 41 provides a constant supply of compressed air to the orifice disk assembly 46 through the main air line 42 and the air inlet conduit 47, respectively. The air flows from the air inlet conduit 47, through the air flow opening 53 (FIG. 12) of the orifice disk 52; through the air outlet conduit 54; and into the pump air delivery line 56, respectively. The air flow opening 53 in the orifice disk 52 acts as an air flow restrictor which controls the quantity of air which flows through the orifice disk assembly 46 per unit time. Flow rates of the air through the air flow opening 53 in the orifice disk 52 are stable and predictable as long as the air pressures on both sides of the orifice disk 52 remain constant. Therefore, the quantity of air which is distributed through the orifice disk assembly 46 to the air chamber 2 of the geyser pump 1, and thus, the size of each liquid-moving bubble 36 (FIGS. 7-10) formed in the bubble-forming loop 14 and the quantity of liquid 34 which the liquid-moving bubble 36 pushes or transports through the liquid delivery conduit 30 during each pumping cycle, is directly proportional to the diameter of the air flow opening 53 in the orifice disk 52.

The desired flow rate or volume of air delivered to the geyser pump 1 and thus, the desired flow rate or volume of the liquid 34 which is pumped through the liquid delivery conduit 30 during each pumping cycle, can be selected by selecting an orifice disk 52 having an air flow opening 53 (FIG. 12) with a selected diameter. Therefore, the orifice disk 52 may be field-replaceable. Multiple orifice disks 52 can be manufactured with different-sized air flow openings 53 to yield various liquid flow rates from the geyser pump 1. The air flow rate for each desired liquid flow rate may be determined by testing. A line graph which indicates the results of such a test is illustrated in FIG. 13. On the line graph, the rate of flow of liquid 34 in the liquid delivery conduit 30 (in gallons per day) is plotted as a function of the diameter (in inches) of the air flow opening 53 in the orifice disk 52. In the embodiment of the orifice disk assembly 46 which is illustrated in FIG. 12, the orifice disk 52 may be replaced with an orifice disk 52 having an air flow opening 53 with a larger or smaller diameter, depending on the desired flow rate or volume of liquid 34 in the liquid delivery conduit 30 (FIG. 11), by unthreading the retaining nut 51 from the exterior conduit threads 48 of the air inlet conduit 47; removing the air outlet conduit 54 from the second seal gasket 50*a* and the second seal gasket 50*a* from the orifice disk 52; removing the orifice disk 52 from the first seal gasket 50; seating the replacement orifice disk 52 on the first seal gasket 50; replacing the second seal gasket 50*a* on the orifice disk 52 and the air outlet conduit 54 on the second seal gasket 50*a*; and threading the retaining nut 51 on the exterior conduit threads 48 of the air inlet conduit 47.

Referring next to FIG. 14 of the drawings, in some applications the liquid recirculation/transfer system 70 may be part of a water treatment system 40, an illustrative embodiment of which is illustrated. The water treatment system 40 includes an aerobic treatment unit 61 and a pretreatment tank 62. The aerobic treatment unit 61 contains a supply of liquid 34 in which the geyser pump 1 is submerged. A discharge end 42*a* of the main air line 42 is also submerged in the liquid 34 in the aerobic treatment unit 61. A diffuser 66 is disposed in pneumatic communication with the discharge end 42*a*. The liquid delivery conduit 30, which communicates with the bubble-forming loop 14 of the geyser pump 1 as was heretofore described, discharges over the pretreatment tank 62.

In operation of the water treatment system 40, the liquid recirculation/transfer system 70 is operated as was heretofore described with respect to FIG. 11. Accordingly, the orifice disk assembly 46 receives a supply of air from the aerator 41 through the air inlet conduit 41. For each pumping cycle, the geyser pump 1 receives a controlled quantity of air from the orifice disk assembly 46 and pumps the corresponding quantity of liquid 34 from the aerobic treatment unit 61 through the liquid delivery conduit 30 and discharges the recirculated liquid 34*a* into the pretreatment tank 62. Additionally, air flows from the main air line 42 to the diffuser 66 which is submerged in the liquid 34 at the discharge end 42*a* of the main air line 42. Operation of the aerator 41/diffuser 66 and the geyser pump 1 stabilizes air pressure on both sides of the air flow opening 53 (FIG. 12) in the orifice disk 52 of the orifice disk assembly 46. The diffuser 66 oxygenates the aerobic treatment unit 61 by bubbling air 35*a* into the liquid 34 at a selected depth. The design of the diffuser 66 is such that the backpressure developed in the main air line 42 is dominated by the depth of the liquid 34 at which the air 35*a* is released. The diffuser 66 may be submerged at a fixed depth in the liquid 34. In addition, the aerobic treatment unit 61 maintains the liquid 34 at a constant level during normal operation of the water treatment system 40. Therefore, air pressure at the inlet of the air flow opening 53 remains constant regardless of variations in the flow rates for the diffuser 66 and the geyser pump 1. The outlet of the air flow opening 53 is connected solely to the geyser pump 1, which is submerged at a fixed depth in the liquid 34. The backpressure which is developed by the geyser pump 1 in the main air line 42 cycles repeatedly during its pumping operation. However, the average backpressure for a given flow rate is fairly constant and is also dominated by the depth of the liquid 34 into which the air 35*a* is released from the diffuser 66.

It will be appreciated by those skilled in the art that the geyser pump 1 has the capability to form a very large liquid-moving bubble 36 (FIGS. 8-10) very quickly in the liquid delivery conduit 30. This generates a tremendous buoyancy which is capable of moving a large volume of liquid 34 above the liquid-moving bubble 36 at very high velocity. The geyser pump 1 requires little air 35 to pump the liquid 34. Each liquid-moving bubble 36 is capable of moving many times its own volume in water. Each liquid-moving bubble 36 moves a predetermined quantity of liquid 34, which corresponds to the volume of liquid 34 above the liquid-moving bubble 36 in the liquid delivery conduit 30. The time which is required to form each liquid-moving bubble 36 is determined by the flow of air into the geyser pump 1. Therefore, the rate of liquid flow is directly proportional to the rate of inlet air flow. A single geyser pump 1 is capable of achieving a wide variety of flow rates. For example, the liquid flow rate on a 1" diameter geyser pump 1 can be varied from 10~200 gallons/hour.

In the geyser pump 1, the air chamber 2 and the liquid delivery conduit 30 are separate chambers. Separation of the air chamber 2 and the liquid delivery conduit 30 has three advantages: first, such separation provides a direct liquid flow path with no internal bends or protrusions that might collect suspended solids. Second, it moves the air chamber 2 and the bubble-forming loop 14 further away from the main flow of liquid containing suspended solids, thereby reducing the chance of solids settling in either. Third, the open lower end 31 of the liquid delivery conduit 30 can be extended below the open lower end 6 of the air chamber 2. This allows the geyser pump 1 to pull liquid 34 from near the bottom of a vessel which is heavily-laden with settled and suspended solids while allowing the air chamber 2 and the bubble-forming loop 14 to operate with liquid 34 higher in the tank that contains fewer solids.

It will be further appreciated by those skilled in the art that the geyser pump 1 is simple in construction and lacks moving parts which otherwise would have a tendency to wear out. All submerged components of the geyser pump 1 may be constructed of PVC or similar plastic material for durability and corrosion resistance.

While the preferred embodiments of the invention have been described above, it will be recognized and understood that various modifications can be made in the invention and the appended claims are intended to cover all such modifications which may fall within the spirit and scope of the invention.

What is claimed is:

1. A geyser pump, comprising:

an air chamber having an air chamber interior;

a generally U-shaped bubble-forming loop having a descending segment disposed in fluid communication with said air chamber, a curved segment extending from said descending segment and an ascending segment extending from said curved segment;

a liquid delivery conduit disposed in fluid communication with said ascending segment of said bubble-forming loop and having an open lower end below said curved segment of said bubble-forming loop; and wherein said descending segment, said curved segment and said ascending segment of said bubble-forming loop are entirely external to said air chamber interior of said air chamber and said liquid delivery conduit.

2. The geyser pump of claim 1 further comprising an air chamber cap provided on said air chamber.

3. The geyser pump of claim 1 wherein said air chamber has a generally elongated, cylindrical configuration.

4. The geyser pump of claim 1 wherein said air chamber has an open lower end.

5. The geyser pump of claim 1 wherein each of said air chamber, said bubble-forming loop and said liquid delivery conduit comprises a rigid material.

6. The geyser pump of claim 1 wherein said bubble-forming loop is disposed in a plane generally parallel to a longitudinal axis of said liquid delivery conduit.

7. A geyser pump, comprising:

a generally elongated air chamber having an upper end, a lower end and an air chamber interior extending between said upper end and said lower end;

a generally U-shaped bubble-forming loop having a generally elongated descending segment disposed in fluid communication with said air chamber interior of said air chamber between said upper end and said lower end, a curved segment extending from said descending segment and a generally elongated ascending segment extending from said curved segment;

a generally elongated liquid delivery conduit disposed in fluid communication with said ascending segment of said bubble-forming loop and having an open lower end below said curved segment of said bubble-forming loop;

wherein each of said descending segment and said ascending segment of said bubble-forming loop is generally parallel to a longitudinal axis of said air chamber; and wherein said descending segment, said curved segment and said ascending segment of said bubble-forming loop are entirely external to said air chamber interior of said air chamber and said liquid delivery conduit.

8. The geyser pump of claim 7 further comprising an air chamber cap provided on said upper end of said air chamber.

9. The geyser pump of claim 7 wherein said air chamber has a generally elongated, cylindrical configuration.

10. The geyser pump of claim 7 wherein said lower end of said air chamber is open.

11. The geyser pump of claim 7 wherein each of said air chamber, said bubble-forming loop and said liquid delivery conduit comprises a rigid material.

12. The geyser pump of claim 7 wherein said bubble-forming loop is disposed in a plane generally parallel to a longitudinal axis of said liquid delivery conduit.

13. A liquid recirculation/transfer system, comprising:

an aerator;

an orifice disk assembly comprising a selected one of a plurality of orifice disks having central air flow openings of various diameters, respectively, provided in pneumatic communication with said aerator, said orifice disks interchangeably positional in said orifice disk assembly;

a geyser pump comprising:

an air chamber having an air chamber interior disposed in pneumatic communication with said central air flow opening of said orifice disk in said orifice disk assembly;

a generally U-shaped bubble-forming loop having a generally elongated descending segment disposed in fluid communication with said air chamber interior of said air chamber, a curved segment extending from said descending segment and a generally elongated ascending segment extending from said curved segment;

a liquid delivery conduit disposed in fluid communication with said ascending segment of said bubble-forming loop and having an open lower end below said curved segment of said bubble-forming loop;

wherein said orifice disks are selectively interchangeable in said orifice disk assembly according to said central air flow openings of various diameters, respectively, to facilitate flow of a selected quantity of air through said geyser pump and a selected quantity of liquid from said geyser pump through said liquid delivery conduit;

wherein each of said descending segment and said ascending segment of said bubble-forming loop is generally parallel to a longitudinal axis of said air chamber; and wherein said descending segment, said curved segment and said ascending segment of said bubble-forming loop are entirely external to said air chamber interior of said air chamber and said liquid delivery conduit.

14. The liquid recirculation/transfer system of claim 13 wherein said air chamber and said liquid delivery conduit of said geyser pump each has an open lower end.

15. A liquid recirculation/transfer system, comprising:

an aerator;

an orifice disk assembly comprising a selected one of a plurality of orifice disks having central air flow openings of various diameters, respectively, provided in pneumatic communication with said aerator;

a geyser pump comprising:

an air chamber having an air chamber interior disposed in pneumatic communication with said central air flow opening of said orifice disk in said orifice disk assembly;

a generally U-shaped bubble-forming loop disposed in fluid communication with said air chamber;

a liquid delivery conduit disposed in fluid communication with said bubble-forming loop;

wherein said orifice disks are selectively interchangeable in said orifice disk assembly according to said central air flow openings of various diameters, respectively, to facilitate flow of a selected quantity of air through said geyser pump and a selected quantity of liquid from said geyser pump through said liquid delivery conduit;

wherein said bubble-forming loop comprises a generally donated descending segment disposed in fluid communication with and external to said air chamber interior, a curved segment extending from said descending segment and a generally elongated ascending segment extending from said curved segment and disposed in fluid communication with and external to said liquid delivery conduit; and wherein each of said descending segment and said ascending segment of said bubble-forming loop is generally parallel to a longitudinal axis of said air chamber;

an aerobic treatment unit;

a supply of liquid provided in said aerobic treatment unit;

a diffuser disposed in pneumatic communication with said aerator and submerged in said liquid provided in said aerobic treatment unit;

a pretreatment tank disposed in fluid communication with said liquid delivery conduit; and wherein said geyser pump is submerged in said liquid provided in said aerobic treatment unit.

* * * * *